US005676262A

United States Patent [19]

Justice et al.

[11] Patent Number: 5,676,262

[45] Date of Patent: Oct. 14, 1997

[54] BAKEWARE STORAGE AND DISPENSING SYSTEM

[76] Inventors: Deborah Justice; Roger Justice, both of 63 Edgewood La., Shelbiana, Ky. 41562

[21] Appl. No.: 555,485

[22] Filed: Nov. 8, 1995

[51] Int. Cl.[6] ..... A47F 5/00

[52] U.S. Cl. ..... 211/71; 211/73; 211/49.1

[58] Field of Search ..... 211/71, 72, 73, 211/49.1, 184

[56] References Cited

U.S. PATENT DOCUMENTS

| | | | |
|---|---|---|---|
| 371,044 | 10/1887 | Dimes . | |
| 887,631 | 5/1908 | Hawthorne . | |
| 1,909,543 | 5/1933 | Jordan | 211/73 |
| 2,197,789 | 4/1940 | Dalton . | |
| 2,524,078 | 10/1950 | Priepke . | |
| 3,297,164 | 1/1967 | Hutchinson . | |
| 3,455,462 | 7/1969 | Morgan . | |
| 3,592,344 | 7/1971 | Schede . | |
| 3,759,395 | 9/1973 | Juhlin . | |
| 4,045,103 | 8/1977 | Paolino | 211/71 X |
| 4,503,982 | 3/1985 | Lewis | 211/49.1 |
| 4,557,389 | 12/1985 | Williams et al. . | |
| 4,684,027 | 8/1987 | Wright . | |
| 4,714,165 | 12/1987 | Solomon . | |
| 4,909,398 | 3/1990 | Santucci . | |
| 4,944,413 | 7/1990 | Connell . | |
| 5,096,071 | 3/1992 | Neri | 211/71 |
| 5,292,010 | 3/1994 | Pickles et al. . | |

*Primary Examiner*—Robert W. Gibson, Jr.

[57] ABSTRACT

A holder for storing and dispensing various sizes of bakeware. The holder includes a rear wall joined at opposite edges by forwardly projecting side walls. The side walls extend parallel to one another and each have perpendicular securing tabs at their bottom edge. The securing tabs are to be mounted to a flat surface, such as a kitchen shelf or cabinet, so that the bakeware may be supported in a vertical arrangement by the holder side walls with one edge of the bakeware resting on the flat surface.

13 Claims, 4 Drawing Sheets

BAKEWARE STORAGE AND DISPENSING SYSTEM

BACKGROUND OF THE INVENTION

1. Field of the Invention

This invention relates to storing and dispensing systems in general and more specifically to a system for storing and dispensing bakeware inclusive of, but not limited to, rectangular, square, oval or otherwise varied shaped pans normally used for baking. The invention allows for the storage of cookie sheets, muffin tins, cupcake pans, cake pans, wire racks, small roasting pans, or other pans normally used in baking.

2. Statement of the Problem

Typically the storage of bakeware is simple insertion into the cabinet without any means of support or organization. This practice leads to a cluttered, unsightly appearance within the cabinet and creates difficulty in seeing, removing and replacing desired pieces of bakeware.

Bakeware stored by the typical consumer is usually placed in an unsupported stack that lies flat in the bottom of a cabinet or on a shelf. Utilizing this method, pieces that are used less often tend to end up at the bottom of the stack. When the consumer desires to use one of the bottom pieces, all of the bakeware stacked above it must first be removed. Often a number of pieces must be removed before a desired item can even be found. The end result of such bakeware storage is difficulty in locating and removing the desired piece along with the needless chore of replacing the pieces that were not needed. This type of stacking system is inefficient, disorganized and awkward. The only piece of bakeware which has a distinct ease in being viewed and removed is the piece which, for the present, has the distinction of being on the top of the stack. Since most pieces are typically replaced on top of the stack, the item at the top changes as different pieces are used.

Moreover, when using bakeware stored by this stacking method a consumer utilizes a lot of unnecessary shelf space. When lying flat in a stack some large bakeware pieces often cover most of a shelf and in some instances take up the whole shelf.

Another downfall to this type of stacking is the tendency of the stack to tip over if larger pieces are placed on top of smaller ones. This type of stacking is unstable since there are no means of support for the stack.

The modern consumer has need of a storage and dispensing unit for common household bakeware which: (A) Allows ease of visibility from the front or top. (B) Allows for easy removal or replacement of stored bakeware. (C) Provides storage for various sizes and shapes of bakeware within a single unit. (D) Requires only a limited amount of space to install. (E) Can be installed on or under existing shelving. (F) Provides simple installation using common household tools.

SUMMARY OF THE INVENTION

It is, therefore, an objective of the present invention to provide a bakeware storage and dispensing holder capable of holding different sizes and varieties of commonly used household bakeware in an upright position, and to fulfill these needs by providing a well designed, modern, attractive storage unit that not only works well but also offers relatively inexpensive storage for several pieces of bakeware within a single unit.

A further objective of the present invention is to provide a bakeware storage and dispensing holder which permits bakeware to be quickly and easily inserted and removed.

A still further objective of the invention is to provide a storage and dispensing holder which may be accommodated on a flat surface and may be installed on or under existing shelving or cabinets.

It is yet a further objective of this invention to provide a storing and dispensing holder which is unobtrusive in appearance and that visually blends in with stored bakeware to give the appearance of bakeware standing on its own without additional support while allowing the user to easily view each piece.

A still further objective of this invention is to provide a bakeware storage and dispensing holder that allows for its easy removal once installed for cleaning, storage, moving or shipping.

To achieve these and other objectives, the present invention provides for a holder comprised of a first vertical side wall having a top edge, a bottom edge, a front edge, and a rear edge, extending perpendicularly from said bottom edge is at least one securing tab for securing the holder to a flat surface; a second vertical side wall spaced in a parallel relationship with respect to said first vertical side wall, said second vertical side wall having a top edge, a bottom edge, a front edge, and a rear edge, extending perpendicularly from said bottom edge of said second side wall is at least one securing tab for securing the holder to a flat surface; and a vertical rear wall perpendicular to said first and second vertical side walls, said vertical rear wall having a top edge, a bottom edge, and first and second side edges; wherein the first and second side edges of said rear wall are joined respectively with the rear edge of the first vertical side wall and the rear edge of the second vertical side wall, said holder having an unobstructed area extending from below the bottom edges of the first, second and rear vertical walls, between the first and second side walls, beyond the front edges of the first and second vertical walls, and above the top edges of the first, second and rear vertical walls; wherein when said holder is positioned on a flat surface with said securing tabs securing the holder to the flat surface, the holder may store and dispense items which are positioned upright on an edge between the first and second side walls.

In use, bakeware pans are inserted through the open front of the holder in a vertical upright position. The holder is not restricted by an overhead wall, thus different size pieces may be stored without limitations with respect to the height. The present invention provides ease of visibility, removal or replacement of confined bakeware pieces while also keeping them neat and organized.

In a preferred embodiment the securing tab members on the bottom edges of the first and second side walls are formed to engage corresponding slots in two space apart holder base tracks which are adapted for mounting on a fixed flat surface (for example a shelf or counter top). This arrangement allows for easy removal of the holder from where it has been installed so that it may be cleaned.

The present invention may solve a variety of problems in bakeware storage with other embodiments and variations. For instance, with the addition of a flexible or hinge joint between each of the side walls and the rear wall, the bakeware holder has the ability to fold into a compact flat position for ease of shipping, storing or moving.

In another variation of the preferred embodiment the securing tabs have openings for receiving installation screws for fastening the holder to a flat surface, thus eliminating the need for the base track members.

Yet another variation of the preferred embodiment would allow different items to be confined within the storage capacity area by varying the width, height or length of the holder walls. For example, a holder utilizing a wider rear wall and shorter side walls would create ideal storage space for metal and glass lids used to cover cookware.

And yet still another variation of the preferred embodiment would eliminate or change the securing tab openings in order to accommodate nails, pegs, glue, or other methods of securing the tabs to a flat surface.

It is expressly understood that other embodiments and variations of the present invention are within the scope of the inventive concept and that while the invention has been described primarily for the storage of bakeware it is understood that it may have application in the storage of other unrelated items.

DESCRIPTION OF THE INVENTION

The present invention provides a bakeware holder that can accommodate storage of different widths and styles of bakeware in a single unit. This holder can be easily installed inside most cabinetry, on or under existing shelving or on any flat surface. The unique design of this present invention will allow relatively inexpensive storage of common household bakeware in a single unit.

A preferred embodiment of the present invention is illustrated in FIGS. 1–8. This particular embodiment is intended for the storage of common household bakeware items, but may find application in the storage of any items having a length and width which is substantially greater than the item's depth. The holder is particularly useful for the storage of bakeware items such as cake pans, cookie sheets, muffin tins, cupcake pans, wire racks, small roasting pans, and other pans normally used in baking. These items for the typical consumer come in a wide variety of shapes and sizes. Many bakeware items which are even used for the same purposes come in different shapes and sizes; for example, round or rectangular cake pans.

Figure 1:
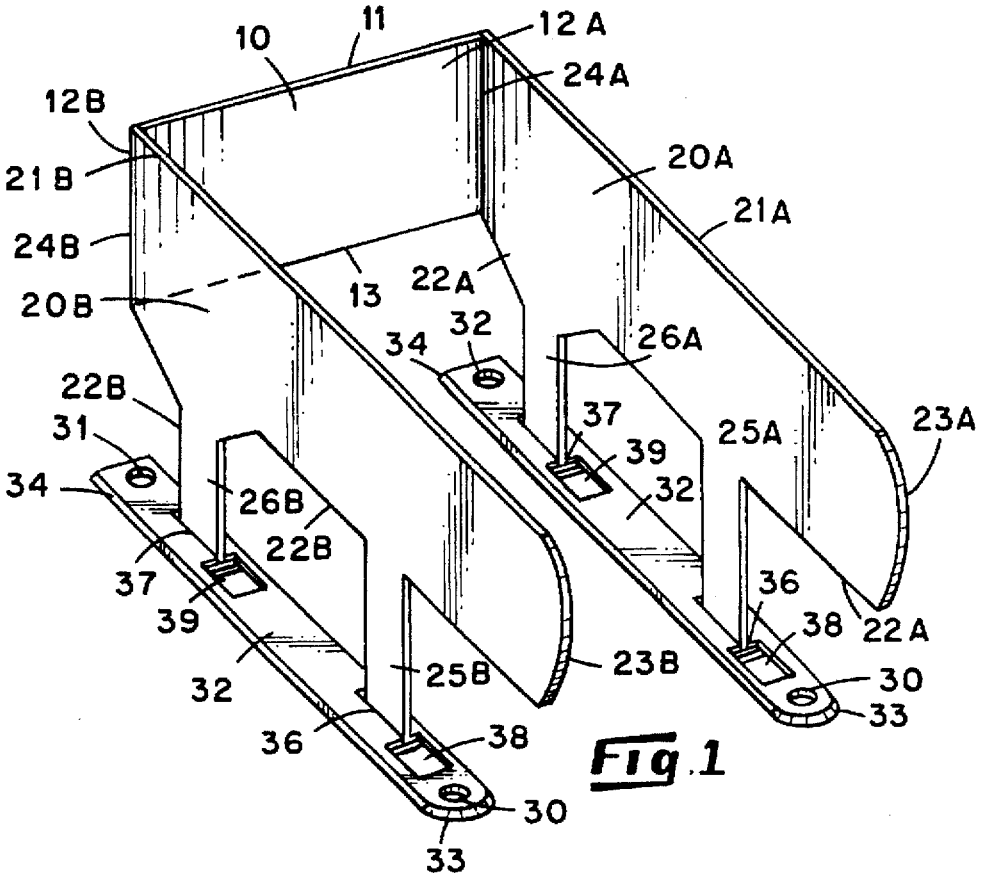
FIG. 1 is a perspective view of the present invention.

The bakeware holder shown in FIG. 1 includes a vertical rear wall 10 extending the width of the holder. The vertical rear wall 10 includes a top edge 11, a bottom edge 13, and first and second side edges 12A and 12B. Extending perpendicularly (approximately 90 degrees) from the first side edge 12A of vertical rear wall 10 is first vertical side wall 20A. First vertical side wall 20A includes a top edge 21A, a bottom edge 22A, a front edge 23A, and a rear edge 24A which is connected with first side edge 12A of rear wall 10. Extending perpendicularly (approximately 90 degrees) from the second side edge 12B of vertical rear wall 10 is second vertical side wall 20B. Second vertical side wall 20B includes a top edge 21B, a bottom edge 22B, a front edge 23B, and a rear edge 24B which is connected with the second side edge 12B of rear wall 10.

In the preferred embodiment, the bottom edges 22A and 22B of the first and second vertical side walls 20A and 20B each include forward support legs 25A and 25B and rearward support legs 26A and 26B. The forward support legs 25A and 25B and the rearward support legs 26A and 26B which form a portion of the bottom edges of the first and second vertical side walls each include at least one securing tab member 27 (See FIG. 2) formed perpendicularly to its respective sidewall. The support legs 25A, 25B, 26A, and 26B are positioned at predetermined distances along the length of the side walls. The tab members 27 are formed so that they may be inserted into openings 38 and 39 of two spaced apart holder base tracks 32 as shown in FIG. 1. Once the tab members 27 are inserted into the respective openings 38 and 39 of base tracks 32, the upper portion of the holder is to be slid rearward moving the tab members 17 from insertion openings 38 and 39 to securing slots 36 and 37 which serve to secure the rear and side walls of the holder in position.

Figure 2:
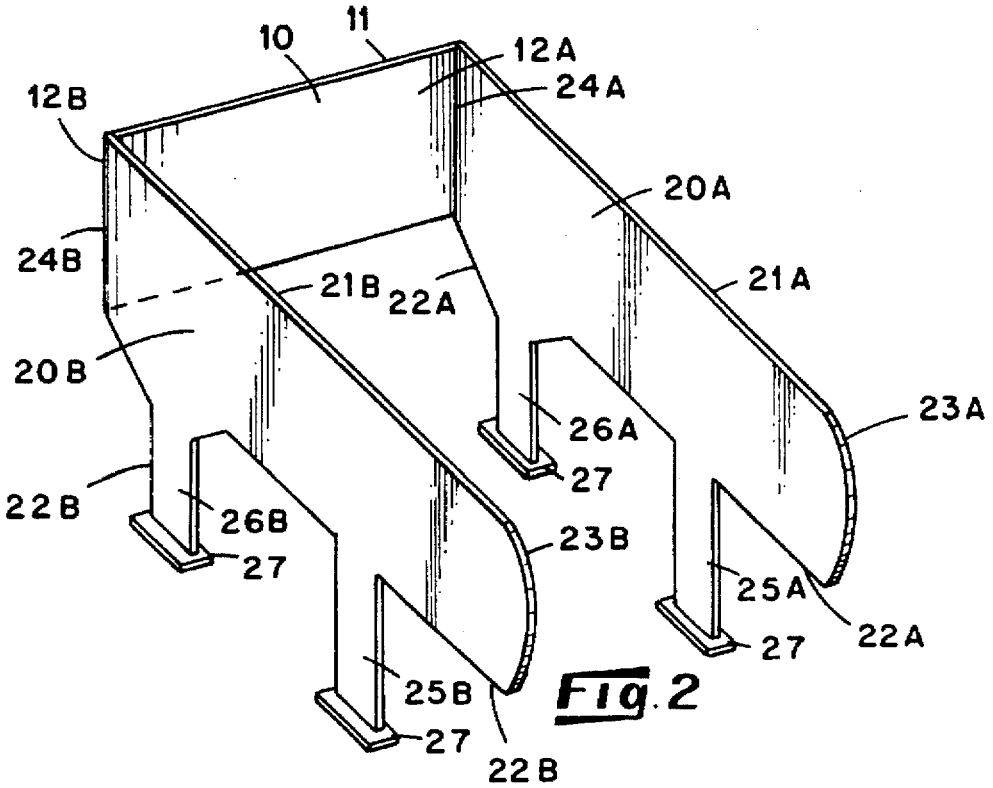
FIG. 2 is a perspective view of the present invention illustrating the securing tabs disengaged from the holder base tracks.
Figure 3:
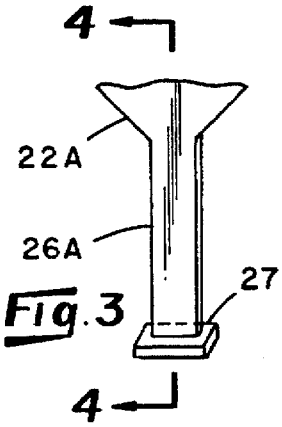
FIG. 3 is a perspective view of a securing tab.
Figure 4:
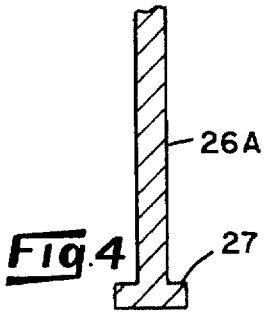
FIG. 4 is a cross-sectional view of FIG. 3 taken along line 4—4.

The bottom edge 13 of vertical rear wall 10 as illustrated in FIGS. 1 and 2 is preferably formed so that it is spaced from the shelf surface when it is attached. Such an arrangement aids in the insertion and removal of the tab members 27 into base track insertion openings 38 and 39, permits the stored items to be more easily seen and reduces the amount of material required for manufacturing the invention. If desired, however, in order add strength and rigidity to the holder the bottom edge 13 of the rear wall 10 may be lowered. Likewise, it should be appreciated that the length of leg members 25A, 25B, 26A, and 26B forming the bottom edges of the first and second side walls may be varied in order to improve visibility of the stored items, strength, or appearance. It is also noted that while the top edges 11, 21A, and 21B of the rear and side walls are illustrated as being horizontal, it is envisioned that the top edges 21A and 21B of the first and second side walls may be taller towards the rear wall 10 which in turn may have a taller top edge 11. Finally, it is noted that while the front edges 23A and 23B of the first and second side walls 21A and 21B are illustrated as being curved, they could also be squared or formed diagonally.

Figure 5:
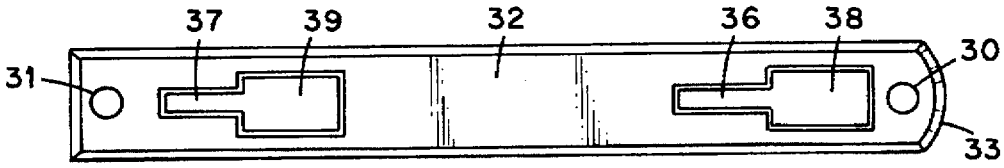
FIG. 5 is an overhead view of one of the base tracks.
Figure 6:
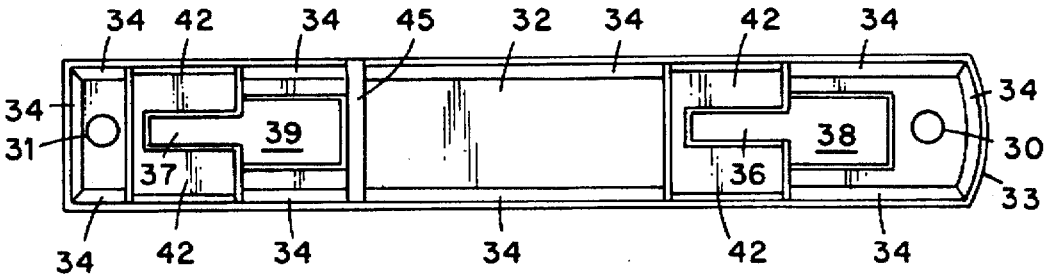
FIG. 6 is a view from the bottom of one of the base tracks.
Figure 7:
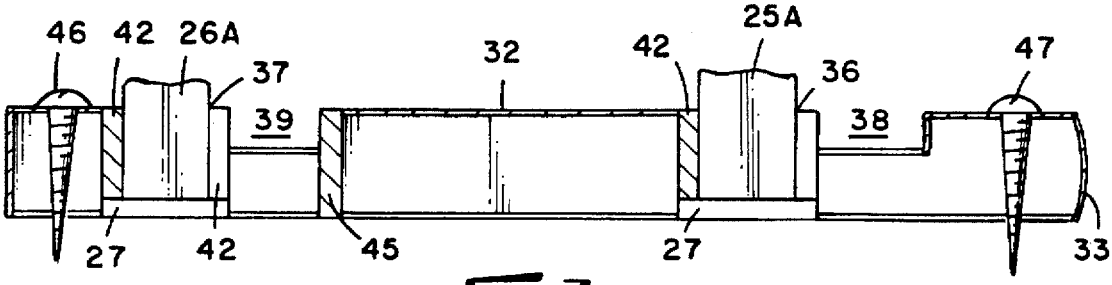
FIG. 7 is a cross-sectional view of a base track with securing tabs positioned in the slots.

The holder base tracks 32, specifically shown in FIGS. 5 and 6, are separate and distinct from the holder upper portion illustrated in FIG. 2. In FIG. 5, an overhead view, the base track 32 is illustrated as including front and rear openings 38 and 39 for receiving the securing tabs 27 of the holder upper portion. The front and rear openings 38 and 39 are joined with rearward projecting securing slots 36 and 37 which have a width smaller than that of the openings. The width of the securing slots 36 and 37 is dimensioned so that the leg members 25A, 25B, 26A and 26B of the first and second side walls 20A and 20B may be accommodated, but at the same time, the width of the slots is smaller than the securing tabs 27 in order to prevent upward movement of the securing tabs 27 through the slots. The holder base tracks 32 are provided with front and rear holes 30 and 31 for receiving installation screws 46 and 47 which serve to secure the base tracks 32 to a shelf or cabinet (FIG. 7).

Figure 8:
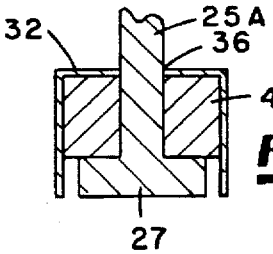
FIG. 8 is a cross-sectional view of a base track with a securing tab positioned in the slot.

FIG. 6 reveals a view of the holder base track 32 from the bottom. The view shows the overall design of the track and the relationship between its different members, including: the front 30 and rear 31 holes for receiving installation screws 46 and 47, the front 38 and rear 39 openings for receiving tab members 27, front 36 and rear 37 securing slots, front and rear securing sections 42 which are located on each side of the slots 38 and 39. The view also reveals retaining wall 45, curved front wall 33, along with showing a side position view of the height and thickness of the base track outer perimeter wall 34 which can be varied according to the needs of the manufacturer. FIGS. 7 and 8 are cross-sectional views of one of the holder base tracks 32 with the securing tab members 27 secured in place in slots 36 and 37.

In use, two holder base tracks 32 are mounted in a spaced parallel relationship by screws 46 and 47 to a shelf, cabinet or flat surface. The holder upper portion is positioned such that the securing tabs 27 are held in position by securing slots 36 and 37 of the two holder base tracks. Bakeware items are then inserted through the open front of the holder in a vertical upright position into the unobstructed space between the first and second side walls. The holder is not restricted by an overhead wall, thus different size pieces may be stored without limitations with respect to the height. The present invention provides ease of visibility, removal or replacement of confined bakeware pieces while also keeping them neat and organized.

The connections between the rear wall 11 and the first 20A and second 20B side walls along edges 12A–24A and 12B–24B are preferably flexible so that the upper portion of the holder may be flattened when not in use for shipping and storage.

FIGS. 9–12 demonstrate variations of the storage holder disclosed in FIGS. 1–8 which eliminate the need for the holder base tracks 32.

Figure 9:
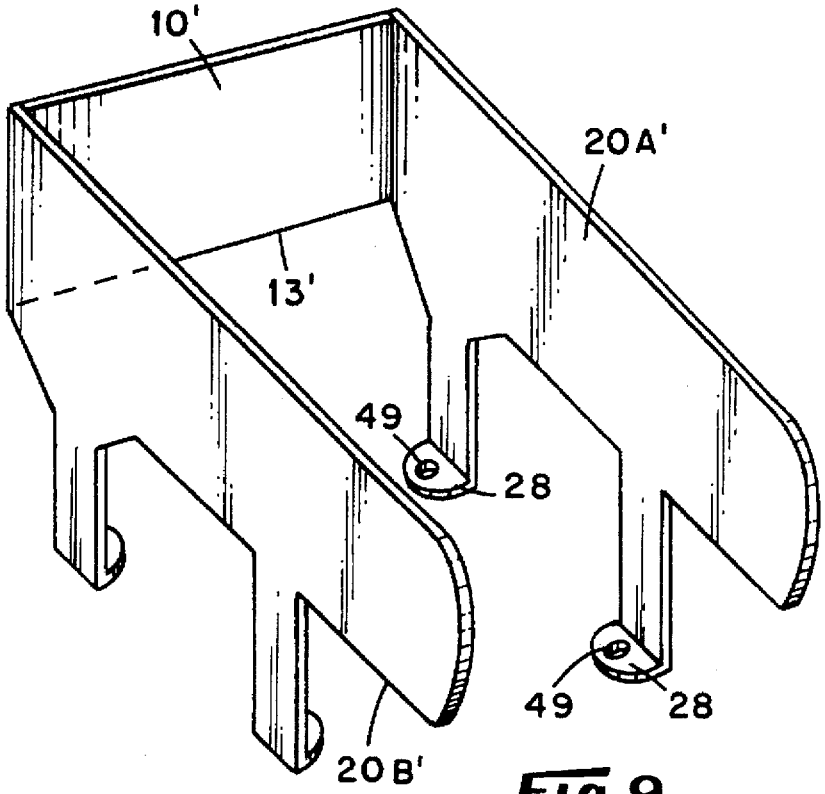
FIG. 9 is a perspective view of another embodiment of the bakeware holder.

The holder of FIG. 9 includes a vertical rear wall 10' having first 20A' and second 20B' vertical sidewalls extending from the rear wall's first and second side walls as previously disclosed for the first embodiment. The holder of FIG. 9 differs from the first embodiment in that the perpendicular securing tabs 28 are designed to be mounted directly to the shelf or cabinet by fasteners 49 (e.g. screws, nails) passing through an opening in the securing tabs 28. Thus, in the variation of FIG. 9, the need for a base track member is eliminated. In FIG. 9, the securing tab members 28 are illustrated as being formed inward, it will be appreciated, however, that the securing tab members may also be formed outward as illustrated at 28' in FIG. 10.

Figure 10:
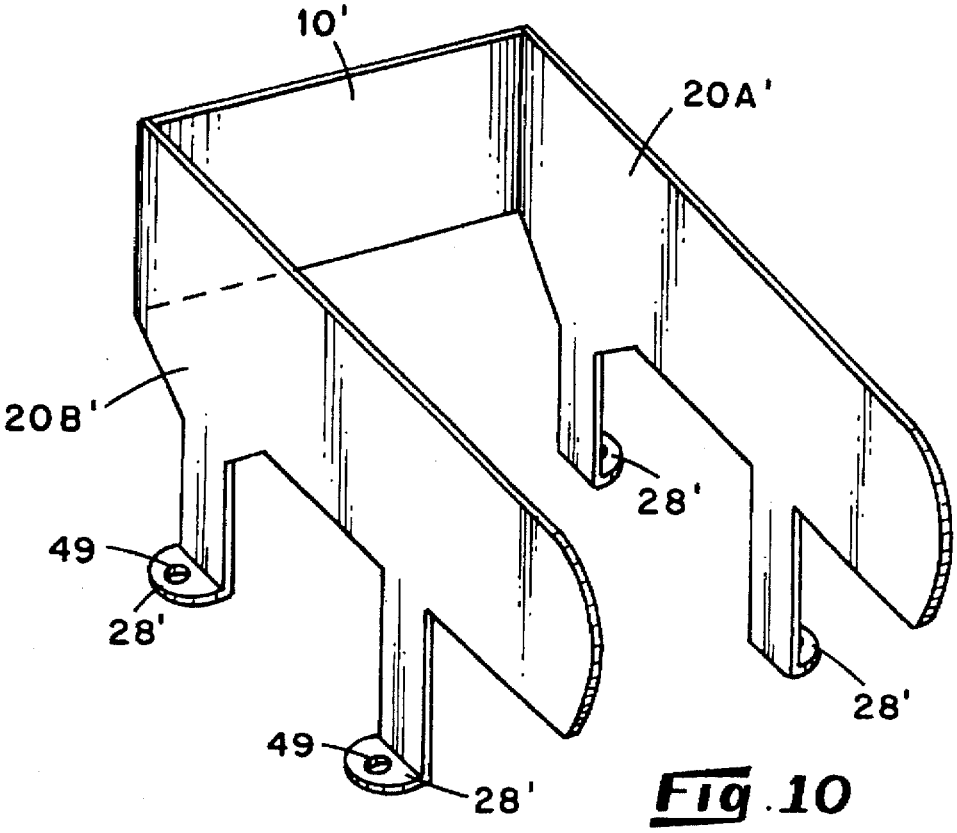
FIG. 10 is a perspective view of another embodiment of the bakeware holder.
Figure 11:
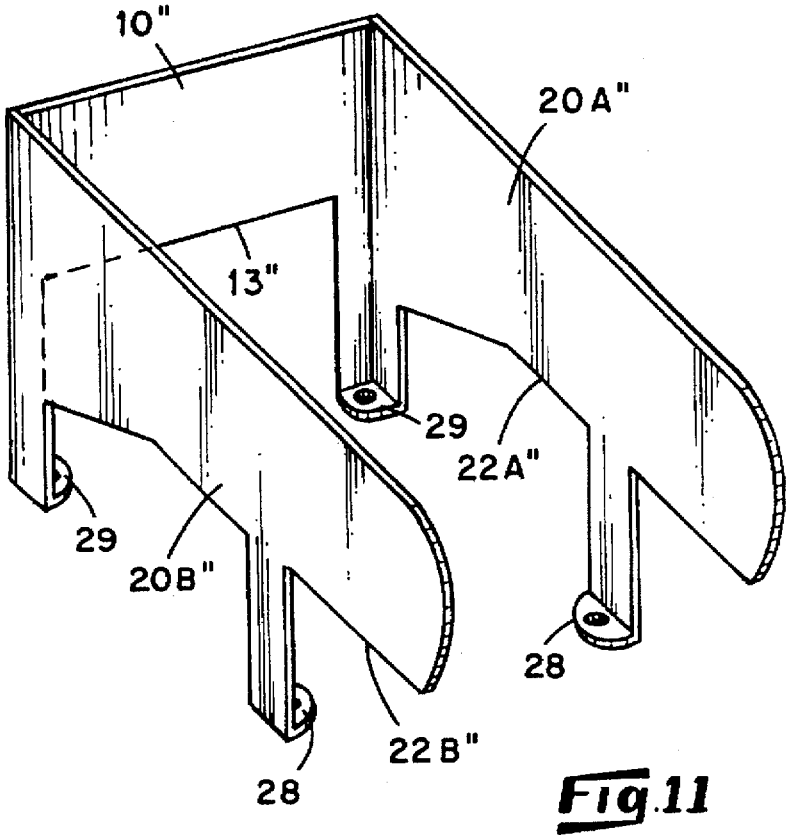
FIG. 11 is a perspective view of another embodiment of the bakeware holder.
Figure 12:
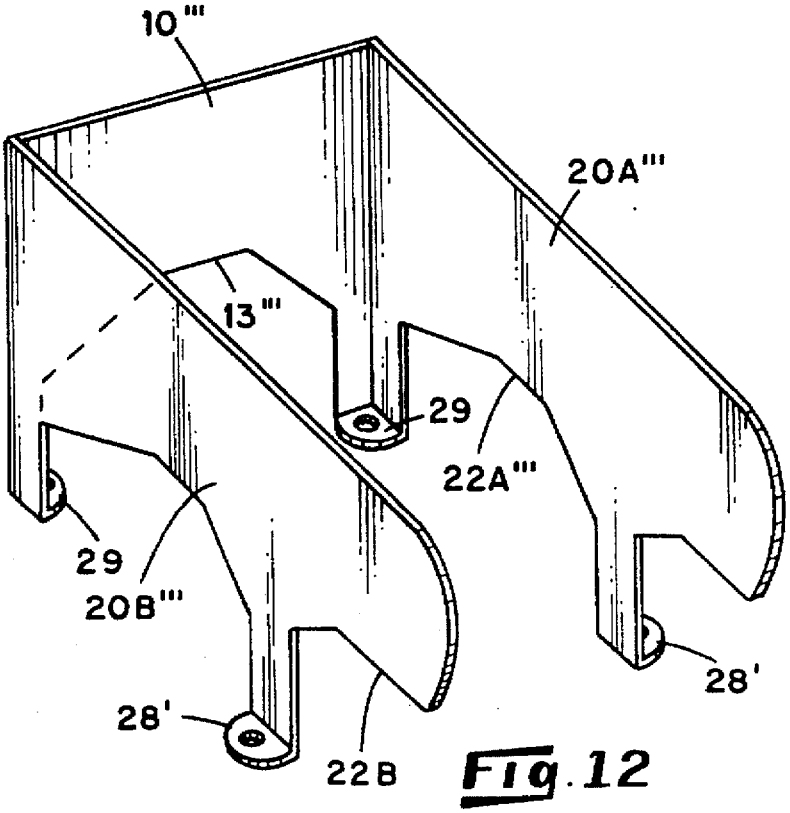
FIG. 12 is a perspective view of another embodiment of the bakeware holder.

FIGS. 11 and 12 show a variation similar to that of FIGS. 9 and 10, except that in order to increase the strength and stability of the holder, the bottom edge 13" of the rear wall 10" has been extended near the first and second sides so that it abuts securing tab 29 of the first 20A" and second 20B" side walls. As noted previously, the securing tabs 28 may be designed to point inwardly or outwardly (28' FIG. 12).

As noted with respect to the first embodiment, the bottom edge 13', 13", 13''' of vertical rear wall 10', 10", 10''' is preferably formed so that at least a portion of it is spaced from the shelf surface when it is attached. Such an arrangement permits the stored items to be more easily seen and reduces the amount of material required for manufacturing the invention. If desired, however, in order add strength to the holder the bottom edge 13 of the rear wall 10 may be lowered even to the extent where it contacts the flat surface along its entire length when secured. Likewise, it should be appreciated that the leg members forming the bottom edges of the first 20A', 20A", 20A''' and second 20B', 20B", 20B''' side walls permit the stored items to be more easily viewed, but may be varied length or even eliminated in order to improve the strength or appearance of the holder. It is also noted that while the top edges of the rear and side walls are illustrated as being horizontal, it is envisioned that top edges of the side walls may be taller towards the rear wall which in turn may have a taller top edge. Finally, it is noted that while the front edges of the first and second side walls are illustrated as being curved, they could also be squared or formed diagonally.

As with the first embodiment, the connections between the rear wall and the first and second side walls in each of the aforementioned variations are preferably flexible so that the holder may be flattened when not in use for shipping and storage.

It is further envisioned that the rear wall may include vertical dividers placed at predetermined distances along the rear wall so that the items stored within the holder may be more easily supported and organized.

To provide strength, durability and relatively low cost of manufacturing and purchasing, the bakeware holder may be manufactured of a metal or a hard plastic; other materials and/or means of forming the illustrated embodiments or any variation thereof are considered to be within the scope of the inventive concept as defined by the following claims.

We claim:

1. A holder for storing and dispensing items which have a length and width substantially greater than the item's depth wherein the holder comprises:

a first vertical side wall having a top edge, a bottom edge, a front edge, a rear edge, and legs having portions which extend downwardly from said bottom edge of said first vertical side Wall and tab portions which are joined to the downwardly-extending portions of the legs so as to extend perpendicularly from said bottom edge of said first vertical side wall for securing the holder to a flat surface;

a second vertical side wall spaced in a parallel relationship with respect to said first vertical side wall, said second vertical side wall having a top edge, a bottom edge, a front edge, a rear edge, and legs having portions which extend downwardly from said bottom edge of said second vertical side wall add tab portions which are joined to the downwardly-extending portions of the legs so as to extend perpendicularly from said bottom edge of said second side wall for securing the holder to a flat surface; and a vertical rear wall perpendicular to said first and second vertical side walls, said vertical rear wall having a top edge, a bottom edge, and first and second side edges; the first and second side edges of said rear wall are joined respectively with the rear edge of the first vertical side wall and the rear edge of the second vertical side wall, said holder having an unobstructed area extending between the first and second side walls, beyond the front edges of the first and second vertical walls, and above the top edges of the first, second and rear vertical walls; wherein when said holder is positioned on a flat surface with said securing tabs securing the holder to the flat surface, the holder may store and dispense items which are positioned upright on an edge between the first and second side walls.

2. The holder of claim 1, wherein said legs of each of said first vertical side wall and said second vertical side wall include a front leg and a rear leg which extend vertically downward from the bottom edge to which the legs are joined, and each securing tab extends perpendicularly from a bottom portion of each of said legs.

3. The holder of claim 2, further including two holder base tracks, wherein each holder base track is comprised of an elongated structure adapted to mounted on a flat surface, said holder base tracks each include a front opening and a rear opening for receiving said securing tabs.

4. The holder of claim 3, wherein the holder base tracks include securing slots extending from said front and rear openings, said securing slots being dimensioned to receive said front and rear legs and to prevent movement of said securing tabs therethrough.

5. The holder of claim 3, wherein the holder base tracks include front and rear holes passing through the base track structure that are adapted to receive screws for mounting the base tracks on a flat surface.

6. The holder of claim 1, wherein the connections between the rear wall and the first and second side walls of the holder are flexible so that the holder may be flattened when not in use for shipping or storage.

7. The holder of claim 6, wherein the securing tabs each have a hole passing therethrough adapted to receive a screw for fastening the holder to a flat surface.

8. The holder of claim 1, wherein the securing tabs each have a hole passing therethrough adapted to receive a screw for fastening the holder to a flat surface.

9. The holder of claim 8, wherein the at least one securing tab on the first side wall projects in a direction toward the second side wall and the at least one securing tab on the second side wall projects in a direction toward the first side wall.

10. The holder of claim 8, wherein the at least one securing tab on the first side wall projects in a direction away from the second side wall and the at least one securing tab on the second side wall projects in a direction away from the first side wall.

11. A method of using the holder of claim 1, wherein the securing tabs are mounted to a kitchen shelf and bakeware items are positioned in the holder between the first and second side walls.

12. A bakeware holder for storing and dispensing bakeware items having a length and width substantially greater than the item's depth wherein the bakeware holder comprises:

a first vertical side wall having a top edge, a bottom edge, a front edge, a rear edge, and legs having portions which extend downwardly from said bottom edge of said first vertical side wall and tab portions which are joined to the downwardly extending portions of the legs so as to extend perpendicularly from said bottom edge of said first vertical side wall for securing the holder to a flat surface;

a second vertical side wall spaced in a parallel relationship with respect to said first vertical side wall, said second vertical side wall having a top edge, a bottom edge, a front edge, a rear edge, and legs having portions which extend downwardly from said bottom edge of said second vertical side wall and tab portions which are joined to the downwardly-extending portions of the legs so as to extend perpendicularly from said bottom edge of said second vertical side wall for securing the holder to a flat surface; and a vertical rear wall perpendicular to said first and second vertical side walls, said vertical rear wall having a top edge, a bottom edge, and first and second side edges; the first and second side edges of said rear wall are joined respectively with the rear edge of the first vertical side wall and the rear edge of the second vertical side wall, said holder having an open area extending between the first and second side walls, beyond the front edges of the first and second vertical walls, and above the top edges of the first, second and rear vertical walls; wherein when said holder is positioned on a flat surface with said securing tabs securing the holder to the flat surface, the holder may store and dispense bakeware items which are positioned upright on an edge between the first and second side walls.

13. A method for organizing and storing bakeware items on a kitchen shelf wherein a holder having a first vertical side wall, a second vertical side wall spaced in a parallel relationship with respect to said first vertical side wall, and a vertical rear wall perpendicular to said first and second vertical side walls joined to a rear edge of the first vertical side wall and a rear edge of the second vertical side wall, is:

mounted along a bottom edge of the holder to said kitchen shelf in a fixed manner; and bakeware items are positioned upright along one edge between the first and second vertical side walls.

* * * * *